US008744117B2

(12) United States Patent
Daley

(10) Patent No.: US 8,744,117 B2
(45) Date of Patent: Jun. 3, 2014

(54) HIGH AMPLITUDE LOUDSPEAKER

(75) Inventor: Michael James Daley, Canonsburg, PA (US)

(73) Assignee: Robert Bosch GmbH, Stuttgart (DE)

( * ) Notice: Subject to any disclaimer, the term of this patent is extended or adjusted under 35 U.S.C. 154(b) by 21 days.

(21) Appl. No.: 13/551,924

(22) Filed: Jul. 18, 2012

(65) Prior Publication Data

US 2013/0279738 A1 Oct. 24, 2013

Related U.S. Application Data

(60) Provisional application No. 61/636,947, filed on Apr. 23, 2012.

(51) Int. Cl.
*H04R 11/02* (2006.01)

(52) U.S. Cl.
USPC ..... 381/423; 381/184; 381/162

(58) Field of Classification Search
USPC ..... 381/162, 165, 174, 184, 423, 191, 190, 381/96, 116
See application file for complete search history.

(56) References Cited

U.S. PATENT DOCUMENTS 2,757,751 A 8/1956 Tavares
2,846,520 A * 8/1958 Brownscombe ..... 381/430
2,904,123 A 9/1959 Nigro
3,547,221 A 12/1970 Hedberg
5,357,586 A 10/1994 Nordschow et al.
5,637,840 A 6/1997 Kim
7,068,806 B2 6/2006 Walsh
7,653,208 B2 1/2010 Guenther
2006/0054382 A1 * 3/2006 Kawahashi et al. ..... 181/262

FOREIGN PATENT DOCUMENTS

DE 20303510 6/2003
GB 2049351 12/1980
JP 6121391 4/1994

* cited by examiner

*Primary Examiner* — Davetta W Goins
*Assistant Examiner* — Amir Etesam
(74) *Attorney, Agent, or Firm* — Michael Best & Friedrich LLP

(57) ABSTRACT

A speaker. The speaker includes a housing, a first electrode, a second electrode, and a diaphragm. The housing has a first end, the first end which includes an acoustic aperture. The first electrode is positioned in the housing a first distance from the first end, and is biased to a first voltage. The second electrode is positioned in the housing a second distance, which is greater than the first distance, from the first end. The second electrode is biased to a second voltage. The diaphragm is positioned in the housing between the first electrode and the second electrode, and is biased to a third voltage. The speaker includes a valve. The valve opens when the diaphragm is moving away from the first end and closes when the diaphragm is stationary or moving toward the first end. When the valve is closed, the diaphragm forms an air-tight seal between the first end and the second electrode.

15 Claims, 4 Drawing Sheets

HIGH AMPLITUDE LOUDSPEAKER

RELATED APPLICATION

This application claims the benefit of U.S. Provisional Patent Application No. 61/636,947, filed Apr. 23, 2012, the content of which is hereby included by reference.

BACKGROUND

The invention relates to a loudspeaker, specifically a loudspeaker generating an amplified sound pressure.

The sound pressure produced by an acoustic source is proportional to the volume of air it moves. Loudspeakers move an air volume equal to their cross-sectional area multiplied by the distance a diaphragm of the loudspeaker moves. To increase the sound pressure of a loudspeaker, the diaphragm is moved a greater distance. Thus, the sound pressure a loudspeaker is able to produce is directly related to the physical size of the loudspeaker.

SUMMARY

In one embodiment, the invention provides a speaker. The speaker includes a housing, a first electrode, a second electrode, and a diaphragm. The housing has a first end, the first end which includes an acoustic aperture. The first electrode is positioned in the housing a first distance from the first end, and is biased to a first voltage. The second electrode is positioned in the housing a second distance, which is greater than the first distance, from the first end. The second electrode is biased to a second voltage. The diaphragm is positioned in the housing between the first electrode and the second electrode, and is biased to a third voltage. The diaphragm includes a valve. The valve opens when the diaphragm is moving away from the first end and closes when the diaphragm is stationary or moving toward the first end. When the valve is closed, the diaphragm forms an air-tight seal between the first end and the second electrode.

In another embodiment the invention provides a method of operating a loudspeaker. The method includes driving, by a first signal, a diaphragm in a first direction and a second direction at a frequency greater than an audible frequency range, opening a valve when the diaphragm is driven in the first direction, closing the valve when the diaphragm is driven in the second direction.

In another embodiment the invention provides a speaker system. The speaker system includes a speaker and a controller. The speaker includes a housing, a first electrode, a second electrode, and a diaphragm. The housing has a first end with an acoustic aperture. The first electrode is positioned in the housing a first distance from the first end, and is biased to a first voltage. The second electrode is positioned in the housing a second distance greater than the first distance from the first end, and is biased to a second voltage. The diaphragm is positioned in the housing between the first electrode and the second electrode, and is biased to a third voltage. The diaphragm also includes a valve. The controller is configured to receive a signal and to control the first voltage, the second voltage, the third voltage, and the opening and closing of the valve based on the signal.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
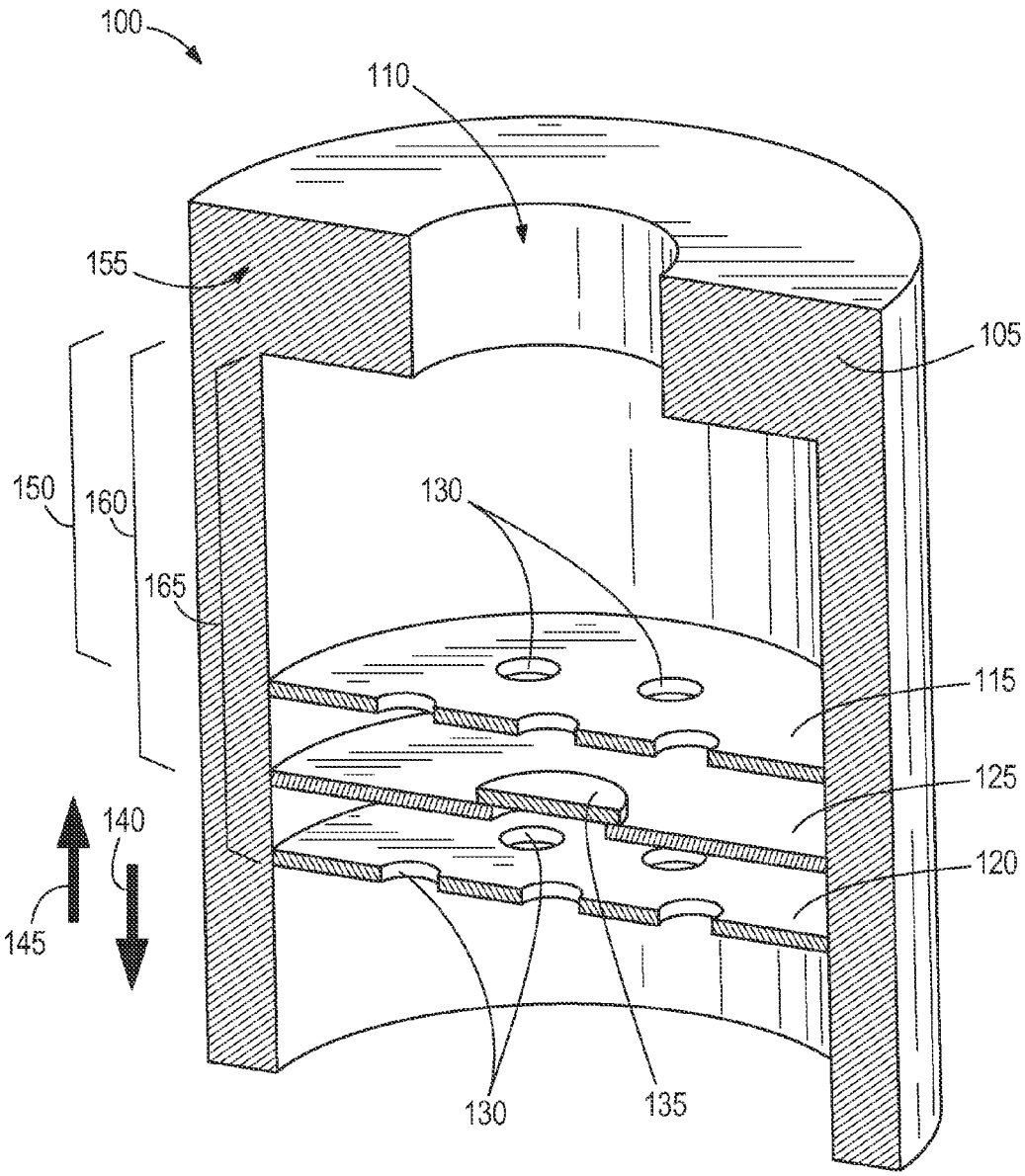
FIG. 1 is a cut-away view of a construction of a speaker.

FIG. 1 shows a cut-away view of a construction of a loudspeaker 100 (e.g., an electrostatic speaker) which stacks multiple pressure pulses within an acoustic cycle to increase the amplitude of the sound waves output by the speaker. The speaker 100 includes a housing 105 having an acoustic aperture 110, a first electrode 115, a second electrode 120, and a diaphragm 125. The first and second electrodes 115 and 120 include a plurality of openings 130 for allowing air to move through the electrodes 115 and 120. The diaphragm 125 includes a valve 135. The valve 135 allows air to pass through the diaphragm 125 when the diaphragm 125 is moving in a first direction 140. The valve 135 provides an air-tight seal for when the diaphragm 125 is stationary or traveling in a second direction 145. In some embodiments, the valve 135 provides an air-tight seal when the diaphragm 125 is traveling in the first direction 140, and allows air to pass when the diaphragm 125 is moving in the second direction 145.

The first electrode 115 is positioned in the housing 105 a first distance 150 from an end 155 of the housing 105 having the acoustic aperture 110. The diaphragm 125 is positioned a second distance 160 from the end 155. The second distance 160 is greater than the first distance 150. The second electrode 120 is positioned a third distance 165 from the end 155. The third distance 165 is greater than the second distance 160. Except when the diaphragm 125 is moving in the first direction 140 the valve 135 and the diaphragm 125 form an air-tight seal in the housing 105.

Figure 2:
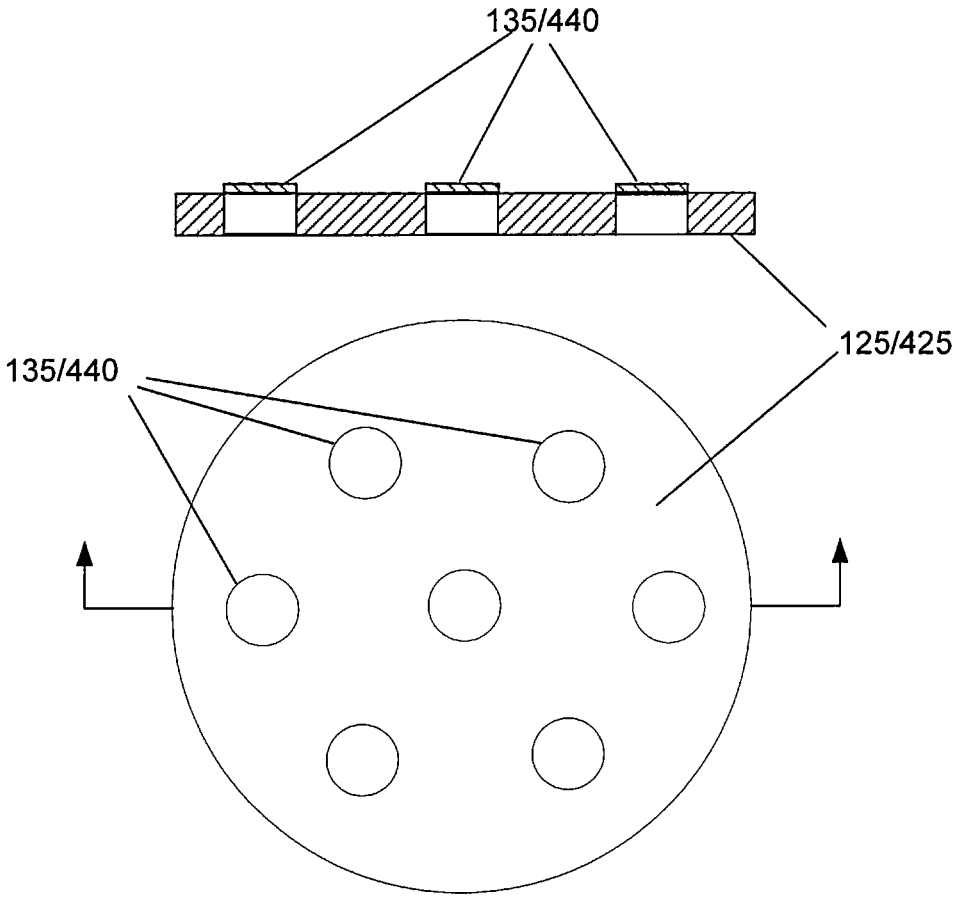
FIG. 2 is a top and cut-away side view of a construction of a diaphragm of the speaker of FIG. 1.

In some constructions, as shown in FIG. 2, the diaphragm 125 includes a plurality of valves 135. Each of the plurality of valves 135 are oriented in the same direction. That is, they all allow air to pass through the diaphragm 125 when the diaphragm 125 is moving in the first direction 140 but not the second direction 145.

In other constructions, the valves 135 are bi-directional. A controller controls when the valves 135 are open and when they are closed, enabling the diaphragm 125 to push or pull air and control the magnitude of sound pressure produced by the speaker 100.

Figure 3:
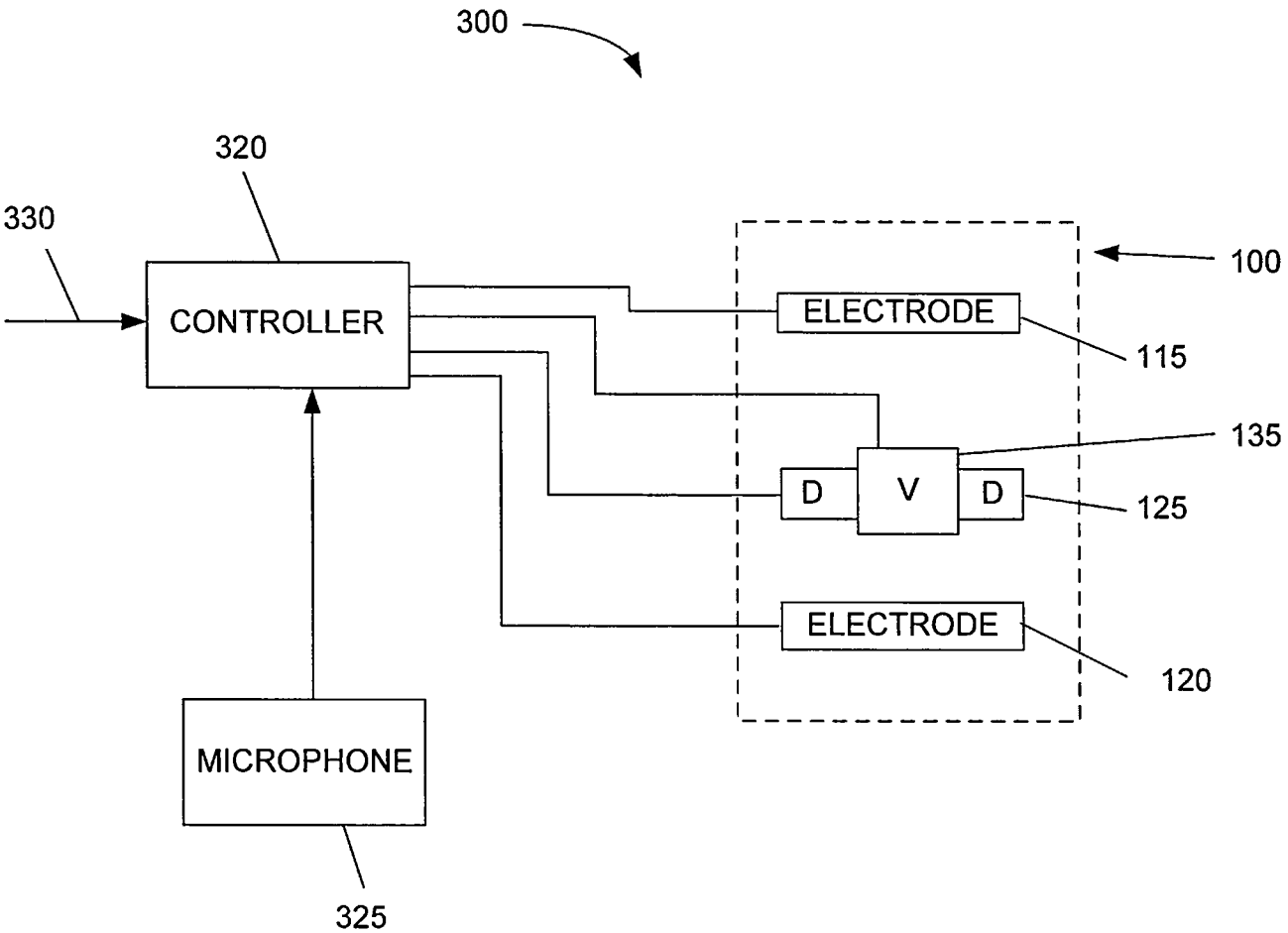
FIG. 3 is a block diagram of a construction of a speaker system.

FIG. 3 shows a block diagram of a speaker system 300. The speaker system 300 includes a speaker 100 (see FIG. 1) including a first electrode 115, a second electrode 120, and a diaphragm 125. The first and second electrodes 115 and 120 include a plurality of openings 130 for allowing air to move through the electrodes 115 and 120. The diaphragm 125 includes a valve 135. The valve 135 allows air to pass through the diaphragm 125 when the valve 135 is open, and prevents air from passing through the diaphragm when the valve 135 is closed. The speaker system 300 also includes a controller 320 and a microphone 325. Depending on the application, the valve 135 can be uni-directional or bi-directional. The controller 320 receives an audio signal 330 and controls the operation of the diaphragm 125 (e.g., by controlling bias voltages on the first and second electrodes 115 and 120 and the diaphragm 125) and valve 135 to produce a sound pressure. The microphone 325 detects the sound pressure and provides a signal indicative of the sound pressure to the controller 320. The controller 320 compares the signal from the microphone 325 to the audio signal 330 and adjusts (e.g., corrects) the operation of the speaker 100 based on the comparison.

Figure 4:
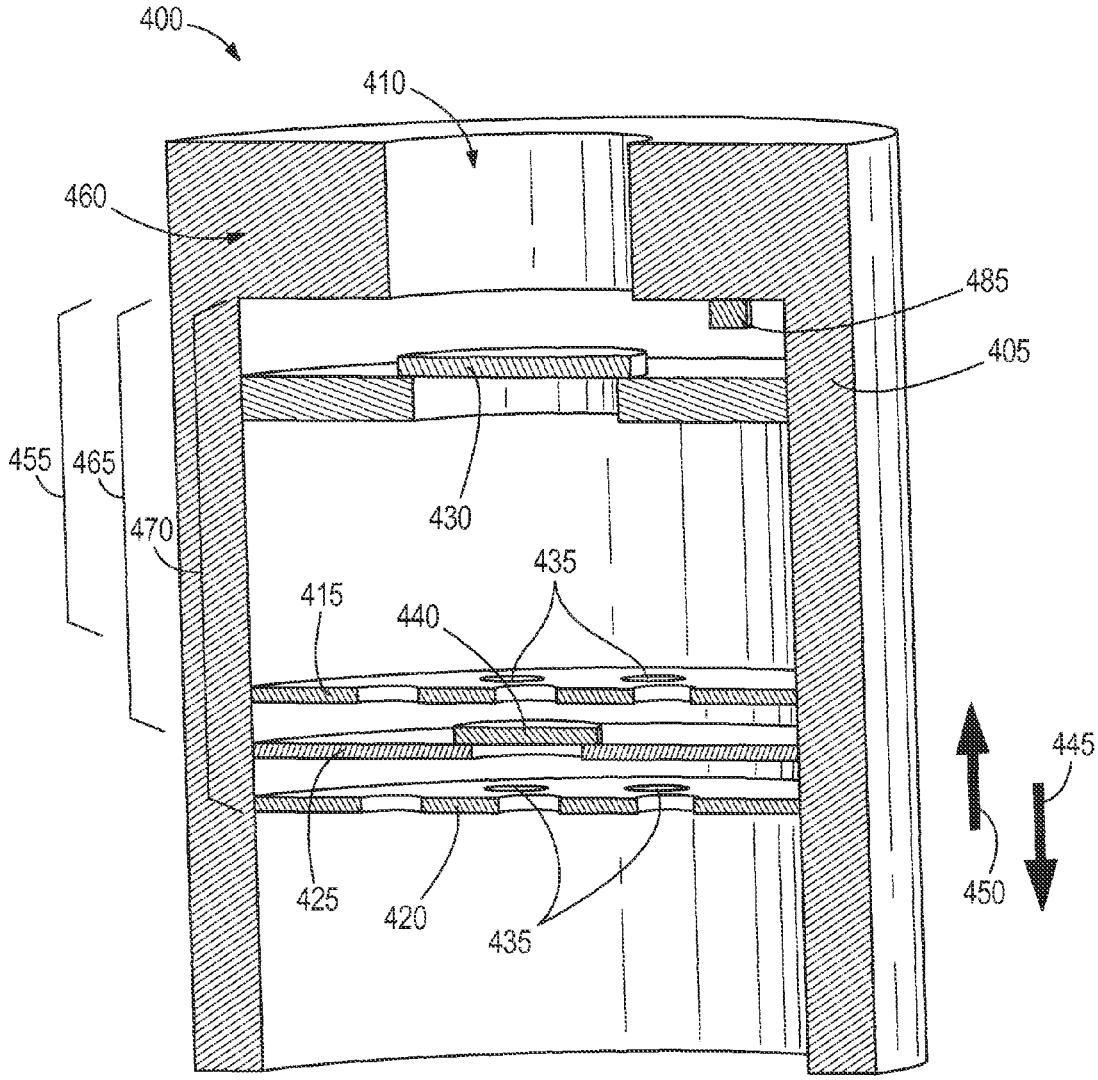
FIG. 4 is a cut-away view of an alternative construction of a speaker.

FIG. 4 shows a cut-away view of another construction of a loudspeaker 400. The speaker 400 forms a bias pressure inside a chamber 402 that is selectively released to form a desired acoustic pressure wave. In this manner, the speaker 400 acts like an acoustic transistor. The speaker 400 includes a housing 405 having an acoustic aperture 410, a first electrode 415, a second electrode 420, a diaphragm 425, and a master valve 430. The first and second electrodes 415 and 420 include a plurality of apertures 435 for allowing air to move through the electrodes 415 and 420. The diaphragm 425 includes a valve 440. The valve 440 allows air to pass through the diaphragm 425 when the diaphragm 425 is moving in a first direction 445, and provides an air-tight seal when the diaphragm 425 is stationary or moving in a second direction 450.

The first electrode 415 is positioned in the housing 405 a first distance 455 from an end 460 of the housing 405 having the acoustic aperture 410. The diaphragm 425 is positioned a second distance 465 from the end 460. The second distance 465 is greater than the first distance 455. The second electrode 420 is positioned a third distance 470 from the end 460. The third distance 470 is greater than the second distance 465. Except for when the diaphragm 425 is moving in the first direction 445, the diaphragm 425 forms an air-tight seal in the housing 405.

Like the first construction embodied in speaker 100, in some constructions, the diaphragm 425 includes a plurality of valves 440. Each of the plurality of valves 440 are oriented in the same direction. In other words, the valves all allow air to pass through the diaphragm 425 when the diaphragm 425 is moving in the first direction 445. The passage of air is blocked by the valves when the diaphragm 425 is moving in the second direction 450.

The diaphragm 425 is vibrated at a relatively high frequency (e.g., much greater than 20 kHz, e.g., 200 kHz). The vibration of the diaphragm 425 and the operation of the valve 440 causes air pressure to build up in the area between the diaphragm 425 and the master valve 430. The master valve 430 is controlled by an audio signal. In one embodiment, alternating cycles of the audio signal open and close the master valve 430 respectively. When the master valve 430 is opened, an air pulse is emitted from the speaker 400. When the master valve 430 is closed, the air pressure between the diaphragm 425 and the master valve 430 builds. In another embodiment, the master valve 430 is controlled in an analog manner by the audio signal, venting the relatively high pressure air in the speaker 400.

Thus, sound waves having a much larger sound pressure level (SPL) than possible with a single cycle of the diaphragm 425 are emitted. The achievable SPL is directly proportional to the frequency of the cycling of the diaphragm 425. The higher the frequency of the cycling of the diaphragm 425, the higher the achievable volume of the sound output by the speaker 400.

In some embodiments, the speaker 400 includes a microphone 485 or other sensor positioned in the chamber between the diaphragm 430 and the acoustic aperture 410, providing an active feedback mechanism for the speaker 400. The microphone 485 detects the air pressure being put out by the speaker 400. The detected pressure is compared with the audio signal and used to control the valve 430.

In other constructions of the speaker 100 or 400, the valve 135/440 is electrically operated, such that an electric signal determines if the valve 135/440 is open or closed. In the embodiments shown, the valves 135 and 440 are positioned on the diaphragms 125 and 425 respectively. In other embodiments, the valves are positioned on a structure adjacent the diaphragm. In some embodiments, multiple valves are used allowing air to pass when the diaphragm is moving in the first or the second direction.

In still other constructions, the diaphragm 125/425 is vibrated by other than electrostatic actuation. For example, the diaphragm can be vibrated by piezo or electrodynamic (e.g., magnetic) actuation.

Various features and advantages of the invention are set forth in the following claims.

What is claimed is:

1. A speaker, comprising:

a housing having a first end, the first end having an acoustic aperture;

a first electrode positioned in the housing a first distance from the first end, the first electrode biased to a first voltage;

a second electrode positioned in the housing a second distance from the first end, the second distance greater than the first distance, the second electrode biased to a second voltage; and a diaphragm positioned in the housing between the first electrode and the second electrode, the diaphragm biased to a third voltage and including a valve, the valve is open when the diaphragm is moving in a first direction and closed when the diaphragm is moving in a second direction opposite the first direction.

2. The speaker of claim 1, wherein the third voltage includes an audio signal and a high-frequency component.

3. The speaker of claim 2, wherein the diaphragm produces air pressure waves that include a high-frequency component and an audio frequency component.

4. The speaker of claim 3, wherein the high-frequency component is filtered by the housing.

5. The speaker of claim 1, wherein the first voltage includes an audio signal and a high-frequency component, and the second voltage is a complement of the first voltage.

6. The speaker of claim 1, further comprising a master valve positioned in the housing between the first electrode and the first end, and modulating a release of pressurized air in the speaker.

7. The speaker of claim 6, wherein the diaphragm vibrates based on a high-frequency signal.

8. The speaker of claim 6, wherein the master valve is controlled by an audio signal.

9. The speaker of claim 6, further comprising a sensor, the sensor detecting an air pressure produced by the speaker, the speaker controlling master valve based on the detected air pressure and an audio signal.

10. The speaker of claim 1, wherein the speaker is an electrostatic speaker.

11. The speaker of claim 1, wherein the first direction is away from the first end and the second direction is toward the first end.

12. The speaker of claim 1, wherein the second direction is away from the first end and the first direction is toward the first end.

13. A speaker system, comprising:

a speaker including a housing having a first end, the first end having an acoustic aperture;

a first electrode positioned in the housing a first distance from the first end, the first electrode biased to a first voltage;

a second electrode positioned in the housing a second distance from the first end, the second distance greater than the first distance, the second electrode biased to a second voltage;

a diaphragm positioned in the housing between the first electrode and the second electrode, the diaphragm biased to a third voltage and including a valve; and a controller configured to receive a signal and to control the first voltage, the second voltage, the third voltage, and the opening and closing of the valve based on the signal.

14. The speaker system of claim 13, further comprising a microphone configured to detect a sound pressure produced by the speaker and to provide an indication of the detected sound pressure to the controller.

15. The speaker system of claim 13, wherein the diaphragm oscillates, moving in a first direction and a second direction opposite the first direction, and the controller opens the valve when the diaphragm is moving in the first direction, the second direction, or both the first and second directions to produces a desired sound pressure.

* * * * *